US009350091B2

(12) United States Patent
Huang et al.

(10) Patent No.: US 9,350,091 B2
(45) Date of Patent: May 24, 2016

(54) ELECTRICAL CONNECTOR AND CONDUCTIVE TERMINAL THEREOF

(71) Applicant: Shenzhen Deren Electronic Co., Ltd., Guangdong (CN)

(72) Inventors: Jinyue Huang, Shenzhen (CN); Zhudong Huo, Shenzhen (CN)

(73) Assignee: Shenzhen Deren Electronic Co., Ltd., Shenzhen, Guangdong (CN)

( * ) Notice: Subject to any disclaimer, the term of this patent is extended or adjusted under 35 U.S.C. 154(b) by 41 days.

(21) Appl. No.: 14/329,184

(22) Filed: Jul. 11, 2014

(65) Prior Publication Data

US 2015/0171540 A1 Jun. 18, 2015

(30) Foreign Application Priority Data

Dec. 18, 2013 (CN) ..... 2013 2 0839700 U

(51) Int. Cl.

| | |
|---|---|
| ***H01R 12/00*** | (2006.01) |
| ***H01R 12/52*** | (2011.01) |
| ***H01R 12/57*** | (2011.01) |
| ***H01R 13/24*** | (2006.01) |
| *H01R 12/71* | (2011.01) |

(52) U.S. Cl.

CPC ..... *H01R 12/52* (2013.01); *H01R 12/57* (2013.01); *H01R 13/2442* (2013.01); *H01R 12/714* (2013.01); *H01R 12/716* (2013.01)

(58) Field of Classification Search

CPC ... H01R 12/57; H01R 13/2435; H01R 13/193

USPC ..... 439/66, 71, 83, 342

See application file for complete search history.

(56) References Cited

U.S. PATENT DOCUMENTS

| | | | | |
|---|---|---|---|---|
| 6,471,534 | B1 * | 10/2002 | Lee | H01R 13/193 439/342 |
| 6,905,377 | B2 * | 6/2005 | Murr | H01R 12/57 439/330 |
| 7,563,105 | B2 * | 7/2009 | Liu | H01R 12/88 439/66 |
| 7,699,638 | B2 * | 4/2010 | Zhang | H05K 7/1084 439/342 |
| 8,342,873 | B2 * | 1/2013 | Liao | H01R 12/57 439/342 |
| 8,366,453 | B2 * | 2/2013 | Chang | H01R 12/58 439/66 |
| 2009/0263985 | A1 * | 10/2009 | Liu | H01R 13/2492 439/66 |

* cited by examiner

*Primary Examiner* — Hien Vu

(74) *Attorney, Agent, or Firm* — Coats & Bennett, P.L.L.C.

(57) ABSTRACT

A conductive terminal includes a base having a plate shape; a welding portion extending from an end of the base and forms an angle with the base; a first positioning portion extending from the end of the base opposite to the welding portion; a second positioning portion extending from the end of the base opposite to the welding portion, the first positioning portion and the second positioning portion are formed on the both sides of the base and spaced apart from each other, being coplanar with the base; a bending portion located between the first positioning portion and the second positioning portion; an elastic arm extending from the bending portion along a direction opposite to the bending portion; and a contact portion configured to be electrically connected to a chip module.

10 Claims, 5 Drawing Sheets

ELECTRICAL CONNECTOR AND CONDUCTIVE TERMINAL THEREOF

CROSS-REFERENCE TO RELATED APPLICATIONS

This application claims priority to Chinese Application No. 201320839700.0, "ELECTRICAL CONNECTOR AND CONDUCTIVE TERMINAL THEREOF", filed on Dec. 18, 2013, which is hereby incorporated by reference in its entirety.

TECHNICAL FIELD

The present disclosure relates to a field of electrical connecting, and more particularly relates to an electrical connector and a conductive terminal thereof.

BACKGROUND

A conventional electrical connector for connecting a chip module and a Printed Circuit Board (PCB) usually includes an insulating body and several conductive terminals. The conductive terminal usually includes: a base, an arm extending from the base, a contact portion electrically connected to the chip module, and a welding portion configured correspondingly to an electrical conductor on the PCB. The arm of the conductive terminal generally has a good resilience and extends outside the insulating body. When the chip module is connected to the PCB, the conductive terminals received in the insulating body are elastically deformed by an external force exerted on the electrical connector, and the elastic force generated by the elastic deformation of the conductive terminals can make the contact portion firmly electrically connect to the chip module and the PCB.

However, the conventional conductive terminal can easily damage the insulating body when it is assembled to the insulating body, and when the conductive terminal is pressed by an external force, it may be easily deflected by an inhomogeneous stress due to its structure defect.

SUMMARY

Accordingly, it is necessary to provide an electrical connector and a conductive terminal thereof that do not damage an insulating body and is not likely to be deflected during assembling.

A conductive terminal includes: a base having a plate shape; a welding portion extending from an end of the base and forms an angle with the base; a first positioning portion extending from the end of the base opposite to the welding portion; a second positioning portion extending from the end of the base opposite to the welding portion, the first positioning portion and the second positioning portion are formed on the both sides of the base and spaced apart from each other, the first positioning portion and the second positioning portion are coplanar with the base, and a surface of the second positioning portion away from the first positioning portion is flat; a bending portion located between the first positioning portion and the second positioning portion; an elastic arm extending from the bending portion along a direction opposite to the bending portion; and a contact portion configured to be electrically connected to a chip module, the contact portion and the bending portion are connected by the elastic arm.

In an embodiment, the first positioning portion forms a protrusion on a side thereof away from the second positioning portion.

In an embodiment, a length of the first positioning portion is different from a length of the second positioning portion.

In an embodiment, the bending portion extends from one side of the second positioning portion facing the first positioning portion.

In an embodiment, an angle formed between the bending portion and the second positioning portion is in a range of 30° to 45°.

In an embodiment, an angle formed between the welding portion and the base is 90°.

In an embodiment, the base forms a stepped portion at an end thereof adjacent to the welding portion.

In an embodiment, a side face of the base from the end thereof adjacent to the welding portion to the stepped portion is an inclined surface.

An electrical connector includes: an insulating body defining a plurality of receiving holes, the insulating body is penetrated by the receiving holes; the plurality of conductive terminals according to claim 1, each conductive terminal is received in one receiving hole; and a plurality of solder balls, each of which being formed on one welding portion, and partly received in each receiving hole, two opposite sidewalls of the receiving hole define a first groove and a second groove, respectively, the first groove is configured to receive the first positioning portion, and the second groove is configured to receive the second positioning portion.

In an embodiment, a side face of the first groove is an inclined surface, the first positioning portion and the side face of the first groove are interference fitted.

In an embodiment, the insulating body further includes a stop portion configured to prevent the conductive terminal from being over inserted in the receiving hole.

The conductive terminal and the electrical connector described above at least have the following advantages:

As the surface of the second positioning portion away from the first positioning portion is flat, during assembling, the conductive terminal can be led to be smoothly inserted into the receiving hole of the insulating body by the flat surface, thus preventing the conductive terminal from damaging the insulating body. After the conductive terminal is assembled to the receiving hole, the first positioning portion and the second positioning portion abut the side face of first groove and the side face of the second groove of the receiving hole, respectively, and the elastic arm extends along a direction opposite to the bending portion, the bending portion is located between the first positioning portion and the second positioning portion, and the elastic arm is also located between the first positioning portion and the second positioning portion, so as to prevent the conductive terminal from shaking and being deflected when the contact portion is pressed by an external force.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
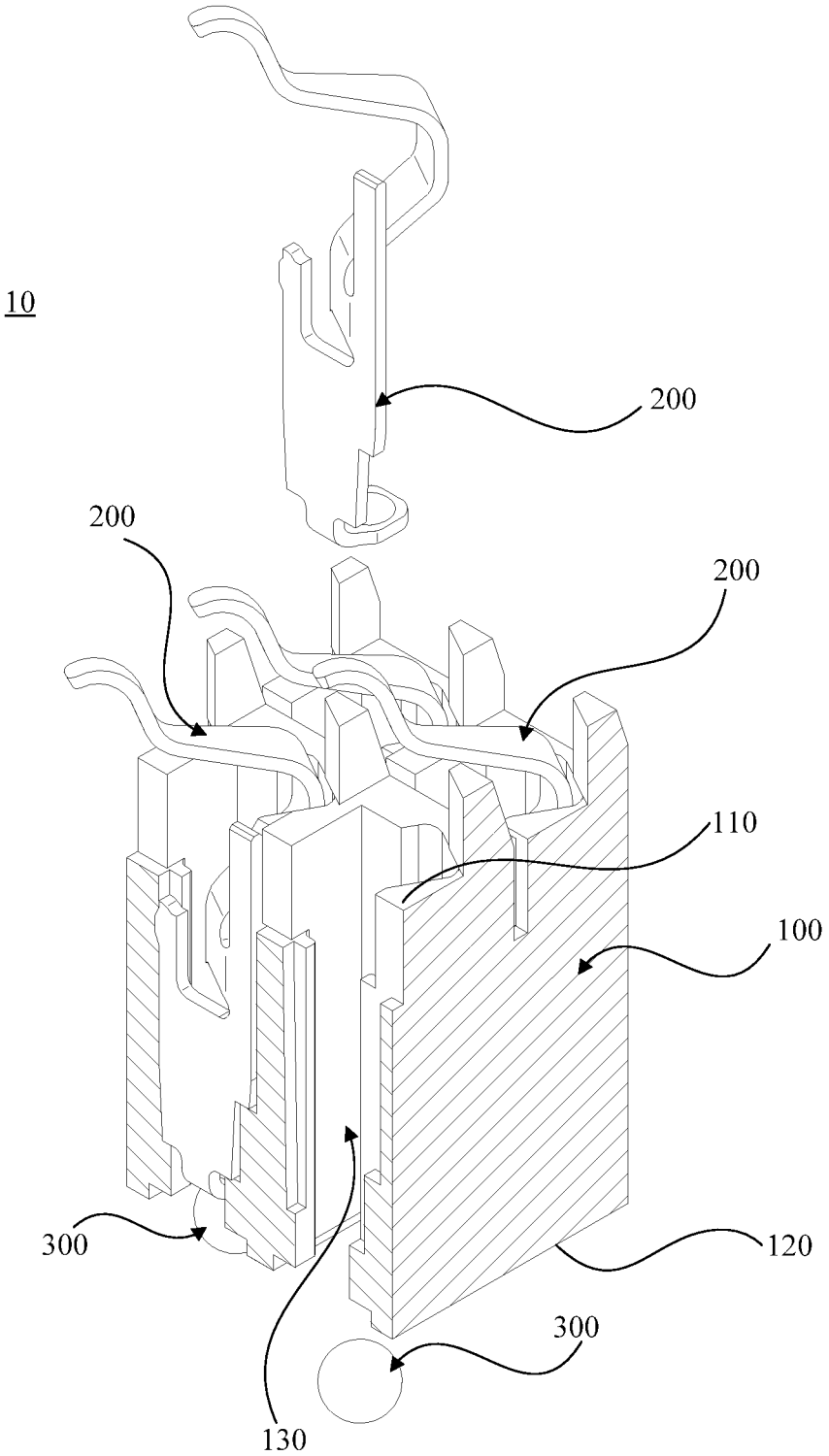
FIG. 1 is a partial perspective view of an electrical connector in accordance with a first embodiment.

Referring to FIG. 1, FIG. 1 is a partial perspective view of an electrical connector 10 in accordance with an embodiment. The electrical connector 10 is mainly used to electrically connect a chip module and a PCB. The electrical connector 10 includes an insulating body 100, a plurality of conductive terminals 200, and a plurality of solder balls 300.

Figure 2:
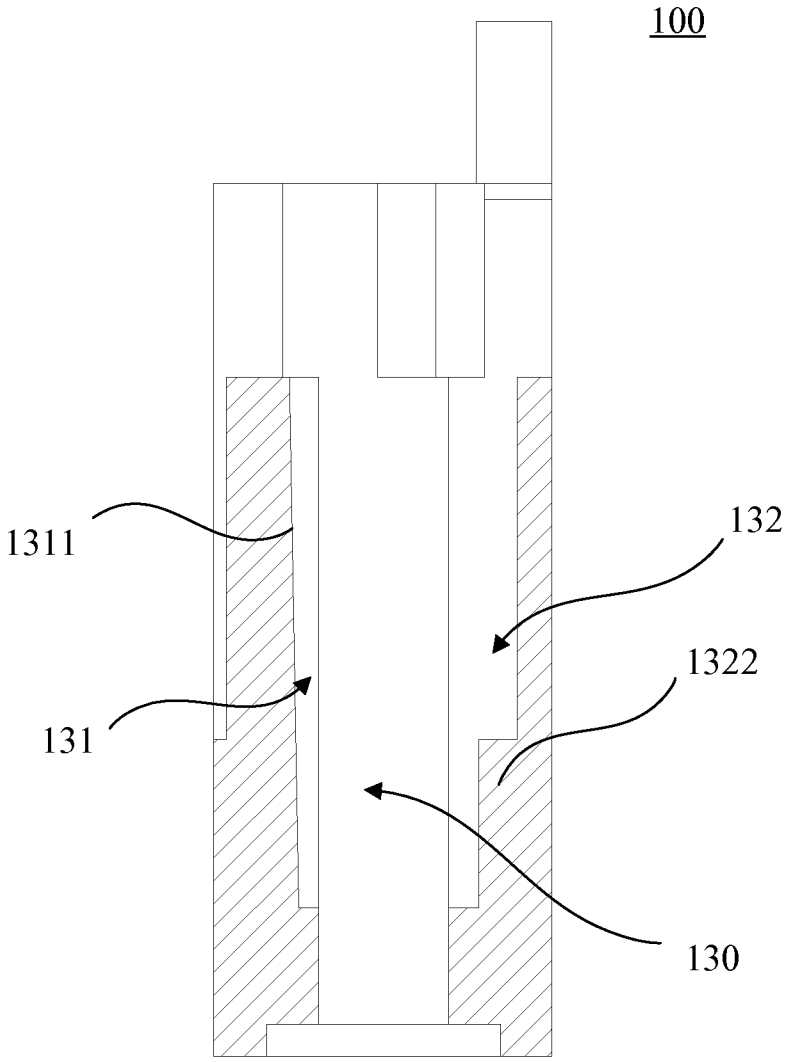
FIG. 2 is a cross-sectional view of an insulating body in FIG. 1.

Referring also to FIG. 2, the insulating body 100 is substantially shaped as a rectangle, which includes a top surface 110 and a bottom surface 120 opposite to the top surface 110. The insulating body 100 defines a plurality of receiving holes 130, and the insulating body 100 is penetrated by the receiving holes 130 from the top surface 110 to the bottom surface 120. Two opposite sidewalls of the receiving hole 130 define a first groove 131 and a second groove 132, respectively.

Figure 3:
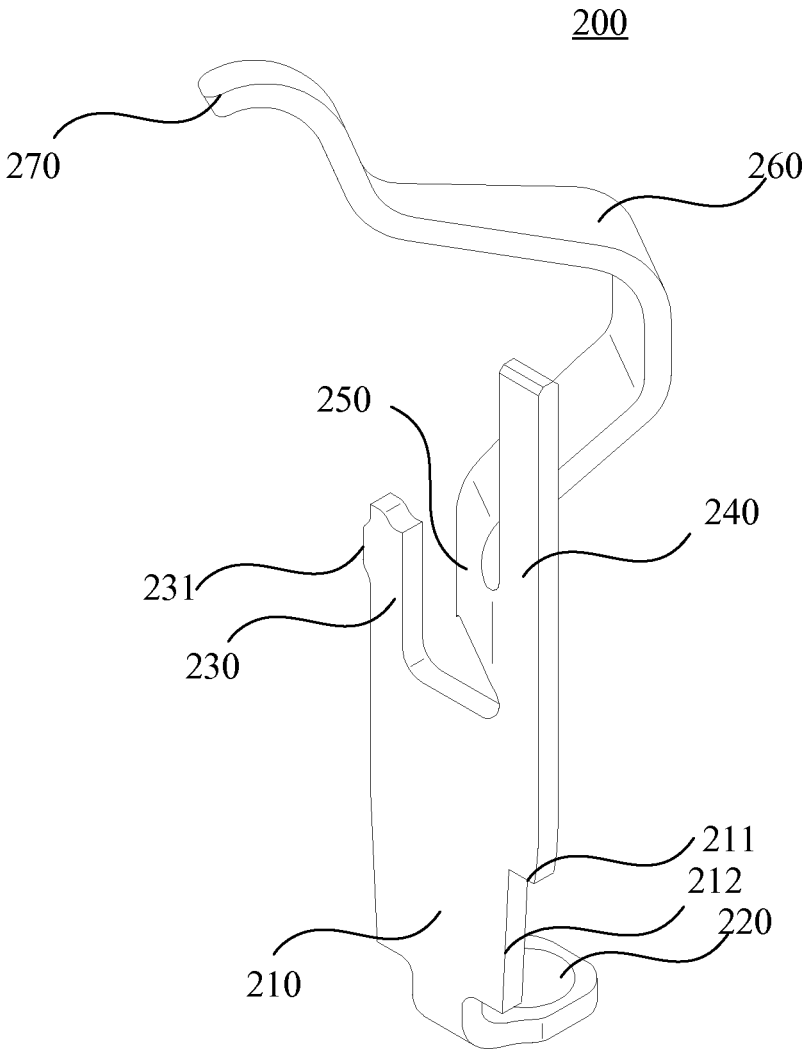
FIG. 3 is a perspective view of a conductive terminal in FIG. 1.
Figure 4:
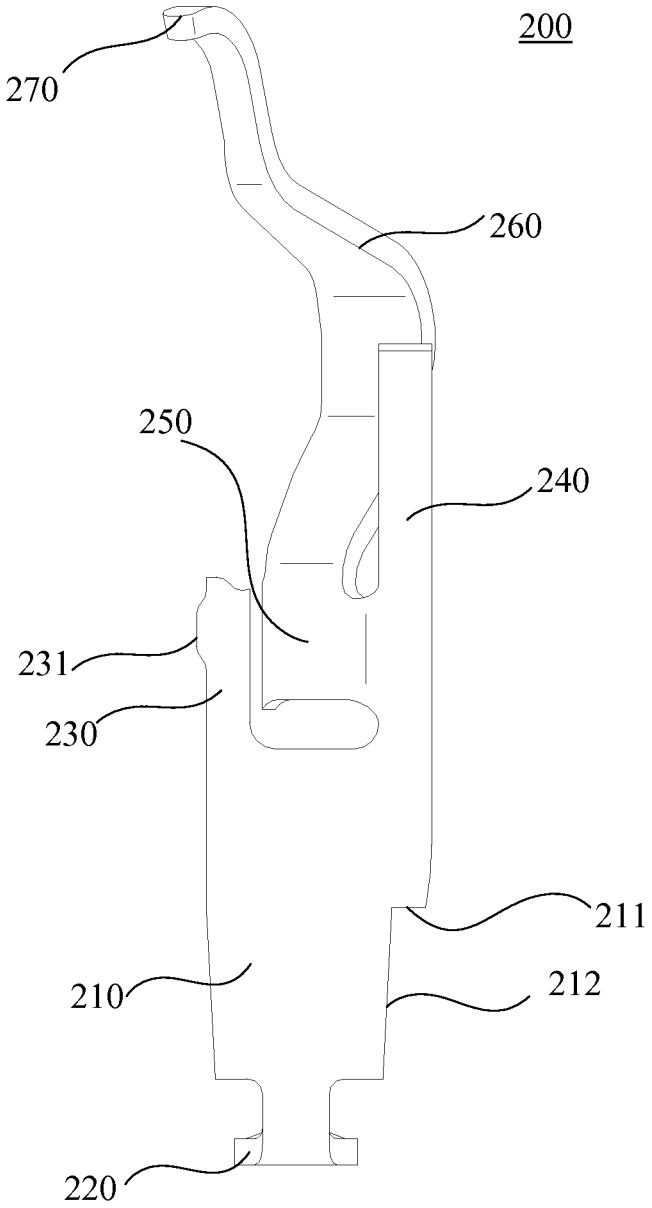
FIG. 4 is another perspective view of the conductive terminal in FIG. 3.
Figure 5:
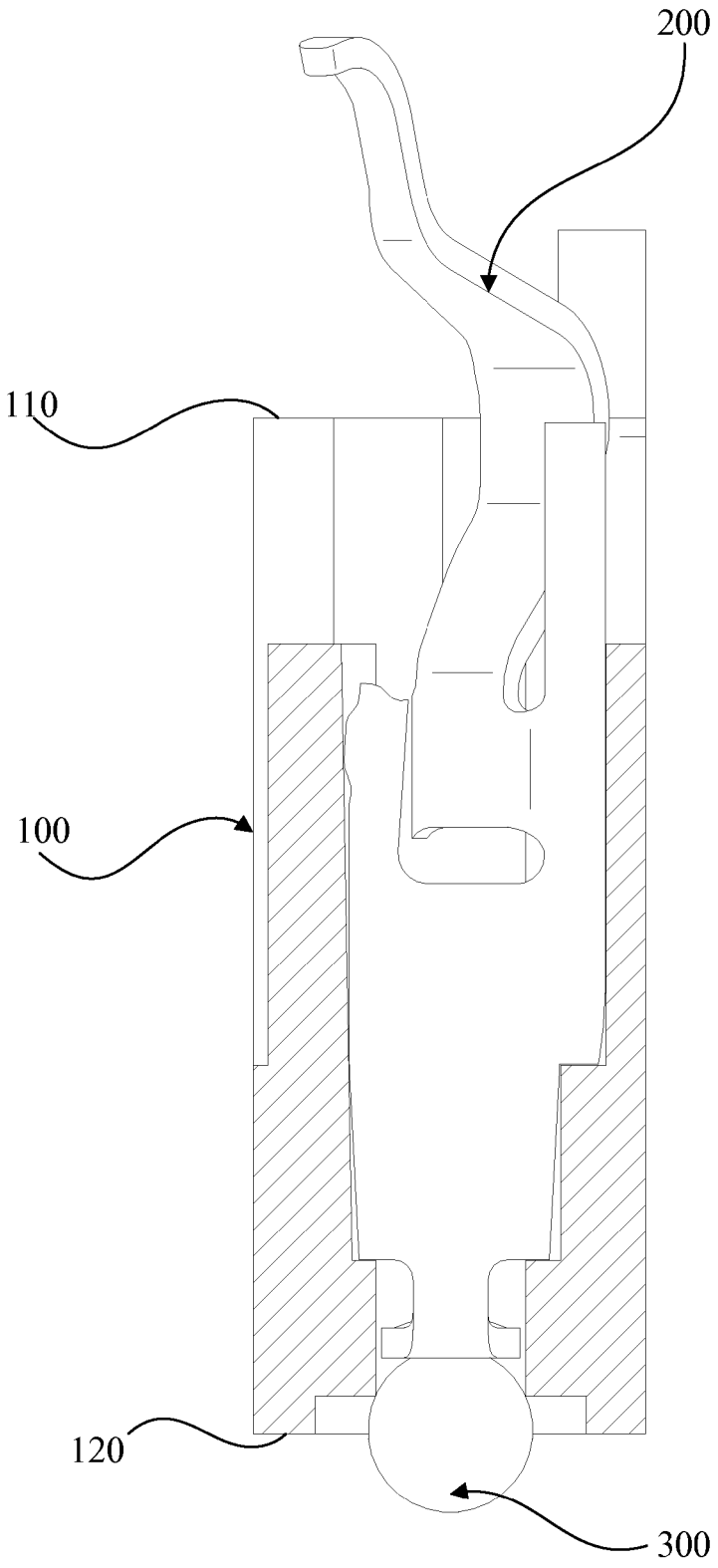
FIG. 5 is a cross-sectional view showing the conductive terminal being received in the receiving hole.

Referring also to FIG. 3 to FIG. 5, an end of each conductive terminal 200 is received in one receiving hole 130. Specifically, each conductive terminal 200 includes a base 210, a welding portion 220, a first positioning portion 230, a second positioning portion 240, a bending portion 250, an elastic arm 260, and a contact portion 270.

The first groove 131 is configured to receive the first positioning portion 230, and the second groove 132 is configured to receive the second positioning portion 240. In the illustrated embodiment, a side face 1311 of the first groove 131 is an inclined surface, the first positioning portion 230 and the first groove 131 is interference fitted through the inclined surface, so as to increase the stability of the conductive terminal 200 when the contact portion 270 is pressed. The insulating body 100 further includes a stop portion 1322. The stop portion 1322 is configured to prevent the conductive terminal 200 from over inserting in the receiving hole 130. It should be understood that, in alternative embodiments, the side face of the first groove may also be flat.

The base 210 has a substantially plate shape. The welding portion 220 extends from an end of the base 210, and forms an angle with the base 210. In the illustrated embodiment, the angle formed between the welding portion 220 and the base 210 is 90°. The base 210 forms a stepped portion 211 at an end thereof adjacent to the welding portion 220. Cooperated with the stop portion 1322, the stepped portion 211 can prevent the conductive terminal 200 from being over inserted into the receiving hole 130 when the conductive terminal 200 is assembled to the insulating body 100. A sidewall 212 of the base 210 from the end thereof adjacent to the welding portion 220 to the stepped portion 211 is an inclined surface. After the conductive terminal 200 is assembled to the receiving hole 130 of the insulating body 100, the inclined surface can increase the clamping force between the base 210 and the inner surface of the receiving hole 130, and prevent the conductive terminal 200 shaking in the receiving hole 130 when the contact portion 270 is pressed.

The first positioning portion 230 extends from an end of the base 210 opposite to the welding portion 220. The second positioning portion 240 extends from the end of the base 210 opposite to the welding portion 220, the first positioning portion 230 and the second positioning portion 240 are formed on the both sides of the base 210 and spaced apart from each other. Both the first positioning portion 230 and the second positioning portion 240 are coplanar with the base 210. The first positioning portion 230 forms a protrusion 231 on a side thereof away from the second positioning portion 240, and the protrusion 231 is cooperated with the side face of the first groove 131. Since the side face of the first groove 131 is an inclined surface, during the first positioning portion 230 entering the receiving hole 130, the interference force between the protrusion 231 and the inclined surface increases, further ensures that the conductive terminal 200 do not shake when the contact portion 270 is pressed. A surface of the second positioning portion 240 away from the first positioning portion 230 is flat, when the conductive terminal 200 is assembled to the insulating body 100, the flat surface can lead the conductive terminal 200 to smoothly insert the receiving hole 130. A length of the first positioning portion 230 is different from that of the second positioning portion 240. For example, in the illustrated embodiment, the length of the second positioning portion 240 is greater than the length of the first positioning portion 230. It should be understood that, the length of the first positioning portion 230 may also be greater than the length of the second positioning portion 240.

The bending portion 250 is located between the first positioning portion 230 and the second positioning portion 240, and is formed by bending one side of the second positioning portion 240 facing the first positioning portion 230 away from the first positioning portion 230. In other embodiments, the bending portion 250 may also be formed by bending one side of the first positioning portion 230 facing the second positioning portion 240 away from the second positioning portion 240. An angle formed between the bending portion 250 and the second positioning portion 240 is in a range of 30° to 45°. The elastic arm 260 extends from the bending portion 250 along a direction opposite to the bending portion 250. The elastic arm 260 is elastically deformed when it is pressed by an external force, and the contact portion 270 and the bending portion 250 are connected by the elastic arm 260. The contact portion 270 is formed at the end of the elastic arm 260, and is configured to be electrically connected to a chip module (not shown).

A plurality of solder balls 300 are formed on a plurality of solder pads 220 of the conductive terminals 200. Each solder pad 220 corresponds to one solder ball 300. The solder ball 300 is partly received in the receiving hole 130 and partly exposed from the bottom 120 of the insulating body 100.

The conductive terminal 200 and the electrical connector 10 described above at least have the following advantages:

As the surface of the second positioning portion 240 away from the first positioning portion 230 is flat, during assembling, the conductive terminal 200 can be led to smoothly insert the insulating body 100 the flat surface, preventing the conductive terminal 200 from damaging the insulating body 100. After the conductive terminal 200 is assembled in the receiving hole 130, the first positioning portion 230 and the second positioning portion 240 abut the side face of first groove 131 and the side face of the second groove 132 of the receiving hole 130, respectively, and the elastic arm 260 extends along a distance opposite to the bending portion 250, the bending portion 250 is located between the first positioning portion 230 and the second positioning portion 240, and the elastic arm 260 is also located between the first positioning portion 230 and the second positioning portion 240, so as to prevent the conductive terminal 200 from shaking and being deflected when the contact portion 270 is pressed by an external force.

Although the present disclosure has been described with reference to the embodiments thereof and the best modes for carrying out the present disclosure, it is apparent to those skilled in the art that a variety of modifications and changes may be made without departing from the scope of the present disclosure, which is intended to be defined by the appended claims.

What is claimed is:

1. A conductive terminal, comprising:

a base having a plate shape;

a welding portion extending from a first end of the base, wherein the welding portion and the base form an angle;

a first positioning portion extending from a second end of the base opposite to the welding portion;

a second positioning portion extending from the second end of the base opposite to the welding portion, wherein the first positioning pod, ion and the second positioning portion are formed on opposing lateral sides of the base and spaced apart from each other, the first positioning portion and the second positioning portion are coplanar with the base, and a surface of the second positioning portion away from the first positioning portion is flat;

a bending portion located between the first positioning portion and the second positioning portion;

an elastic arm extending from the bending portion along a direction opposite to the bending portion; and a contact portion configured to be electrically connected to a chip module, wherein the contact portion and the bending portion are connected by the elastic arm;

wherein a length of the first positioning portion is different from a length of the second positioning portion with the second positioning portion extending a greater distance away from the second end of the base than the first positioning portion; and wherein the bending portion extends from one side of the second positioning portion facing the first positioning portion.

2. The conductive terminal of claim 1, wherein the first positioning portion forms a protrusion on a side thereof away from the second positioning portion.

3. The conductive terminal of claim 1, wherein the bending portion extending from an intermediate section of the second positioning portion between the base and a distal end of the second positioning portion.

4. The conductive terminal of claim 1, wherein an angle formed between the bending portion and the second positioning portion is in a range of 30° to 45°.

5. The conductive terminal of claim 1, wherein an angle formed between the welding portion and the base portion is 90°.

6. The conductive terminal of claim 1, wherein the base forms a stepped portion at the first end thereof adjacent to the welding portion.

7. The conductive terminal of claim 6, wherein a side face of the base from the first end thereof adjacent to the welding portion to the stepped portion is an inclined surface.

8. An electrical connector, comprising:

an insulating body defining a plurality of receiving holes, wherein the insulated body is penetrated by the receiving holes;

a plurality of conductive terminals each comprising:

a base having a plate shape;

a welding portion extending from a first end of the base, wherein the welding portion and the base form an angle;

a first positioning portion extending from a second end of the base opposite to the welding portion;

a second positioning portion extending from the second end of the base opposite to the welding portion, wherein the first positioning portion and the second positioning portion are formed on opposing lateral sides of the base and spaced apart from each other, the first positioning portion and the second positioning portion are coplanar with the base, and a surface of the second positioning portion away from the first positioning portion is flat;

a bending portion located between the first positioning portion and the second positioning portion;

an elastic arm extending from the bending portion along a direction opposite to the bending portion; and a contact portion configured to be electrically connected to a chip module, wherein the contact portion and the bending portion are connected by the elastic arm;

wherein a length of the first positioning portion is different from a length of the second positioning portion with the second positioning portion extending a greater distance away from the second end of the base than the first positioning portion;

wherein each of the plurality of conductive terminals is received in one of the plurality of receiving holes; and a plurality of solder balls, each of which being formed on one welding portion, and partly received in each receiving hole;

wherein each of the plurality of receiving holes comprises two opposite sidewalls that define a first groove and a second groove, respectively, the first groove is configured to receive the first positioning portion, and the second groove is configured to receive the second positioning portion.

9. The electrical connector of claim 8, wherein a side face of the first groove is an inclined surface, the first positioning portion and the side face of the first groove are interference fitted.

10. The electrical connector of claim 8, wherein the insulating body further comprise a stop portion configured to prevent the conductive terminal from being over inserted in the receiving hole.

* * * * *